US008926058B2

(12) United States Patent
Yagi

(10) Patent No.: US 8,926,058 B2
(45) Date of Patent: Jan. 6, 2015

(54) DROPLET JETTING APPARATUS AND MAINTENANCE METHOD OF DROPLET JETTING HEAD

(75) Inventor: Takashi Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 44 days.

(21) Appl. No.: 13/557,822

(22) Filed: Jul. 25, 2012

(65) Prior Publication Data

US 2013/0229455 A1 Sep. 5, 2013

(30) Foreign Application Priority Data

Mar. 1, 2012 (JP) ..... 2012-045480

(51) Int. Cl.
*B41J 2/165* (2006.01)

(52) U.S. Cl.
USPC ..... 347/28

(58) Field of Classification Search
CPC ..... B41J 2/175; B41J 2/17509; B41J 2/195; B41J 2/16552; B41J 2/18
USPC ..... 347/9, 17, 19, 20, 21, 28, 34
See application file for complete search history.

(56) References Cited

U.S. PATENT DOCUMENTS 8,464,652 B2 * 6/2013 Kasuga ..... 118/300
2010/0245451 A1 9/2010 Ihara

FOREIGN PATENT DOCUMENTS

| | | |
|---|---|---|
| JP | 5-309843 | 11/1993 |
| JP | 7-205453 | 8/1995 |
| JP | 3768187 | 2/2006 |
| JP | 2010-228159 | 10/2010 |
| JP | 2011-131458 | 7/2011 |

OTHER PUBLICATIONS

Machine Translation in English of Japanese Application No. 2011-131458; dated Jul. 7, 2011.
Machine Translation in English of Japanese Application No. 3768187; dated Feb. 10, 2006.
Machine Translation in English of Japanese Application No. 5-309843; dated Nov. 22, 1993.
Machine Translation in English of Japanese Application No. 7-205453; dated Aug. 8, 1995.

* cited by examiner

*Primary Examiner* — An Do
(74) *Attorney, Agent, or Firm* — Fildes & Outland, P.C.

(57) ABSTRACT

A droplet jetting apparatus includes: a droplet jetting head that is supplied with a jetting liquid and jets out droplets of the jetting liquid from nozzles formed in a nozzle surface; a spray device that sprays maintenance liquid on the nozzle surface; and a maintenance liquid temperature control unit that controls a temperature of the maintenance liquid so that the temperature of the maintenance liquid comes closer to or becomes higher than or equal to a temperature of the droplet jetting head.

7 Claims, 8 Drawing Sheets

FIG.5

| ΔT(°C) | -15 | -10 | -5 | -1 | 0 | 1 | 5 | 10 | 15 |
|---|---|---|---|---|---|---|---|---|---|
| PRESSURE REDUCTION STATE | C | C | B | A | A | A | A | A | A |

$\Delta T = MT - HT(IT)$

DROPLET JETTING APPARATUS AND MAINTENANCE METHOD OF DROPLET JETTING HEAD

CROSS-REFERENCE TO RELATED APPLICATIONS

This application is based on and claims priority under 35 USC 119 from Japanese Patent Application No. 2012-045480 filed on Mar. 1, 2012.

BACKGROUND

Technical Field

The present invention relates to a droplet jetting apparatus and a maintenance method of a droplet jetting head.

SUMMARY

A droplet jetting apparatus includes: a droplet jetting head that is supplied with a jetting liquid and jets out droplets of the jetting liquid from nozzles formed in a nozzle surface; a spray device that sprays maintenance liquid on the nozzle surface; and a maintenance liquid temperature control unit that controls a temperature of the maintenance liquid so that the temperature of the maintenance liquid comes closer to or becomes higher than or equal to a temperature of the droplet jetting head.

BRIEF DESCRIPTION OF THE DRAWINGS

Exemplary embodiment(s) of the present invention will be described in detail based on the following figures, wherein FIG. 1 schematically shows the overall configuration of an inkjet recording apparatus according to an embodiment of the present invention;

FIG. 5 is a table showing experimental results of a relationship between the difference between the temperature of a maintenance liquid and the temperature of the inkjet recording heads and occurrence of a pressure reduction state inside the inkjet recording heads;

DETAILED DESCRIPTION

Exemplary embodiment(s) of the present invention will be hereinafter described with reference to the drawings.

<Overall Configuration of Inkjet Recording Apparatus>

First, the overall configuration of an inkjet recording apparatus 10 as an example droplet jetting apparatus will be described.

Figure 1:
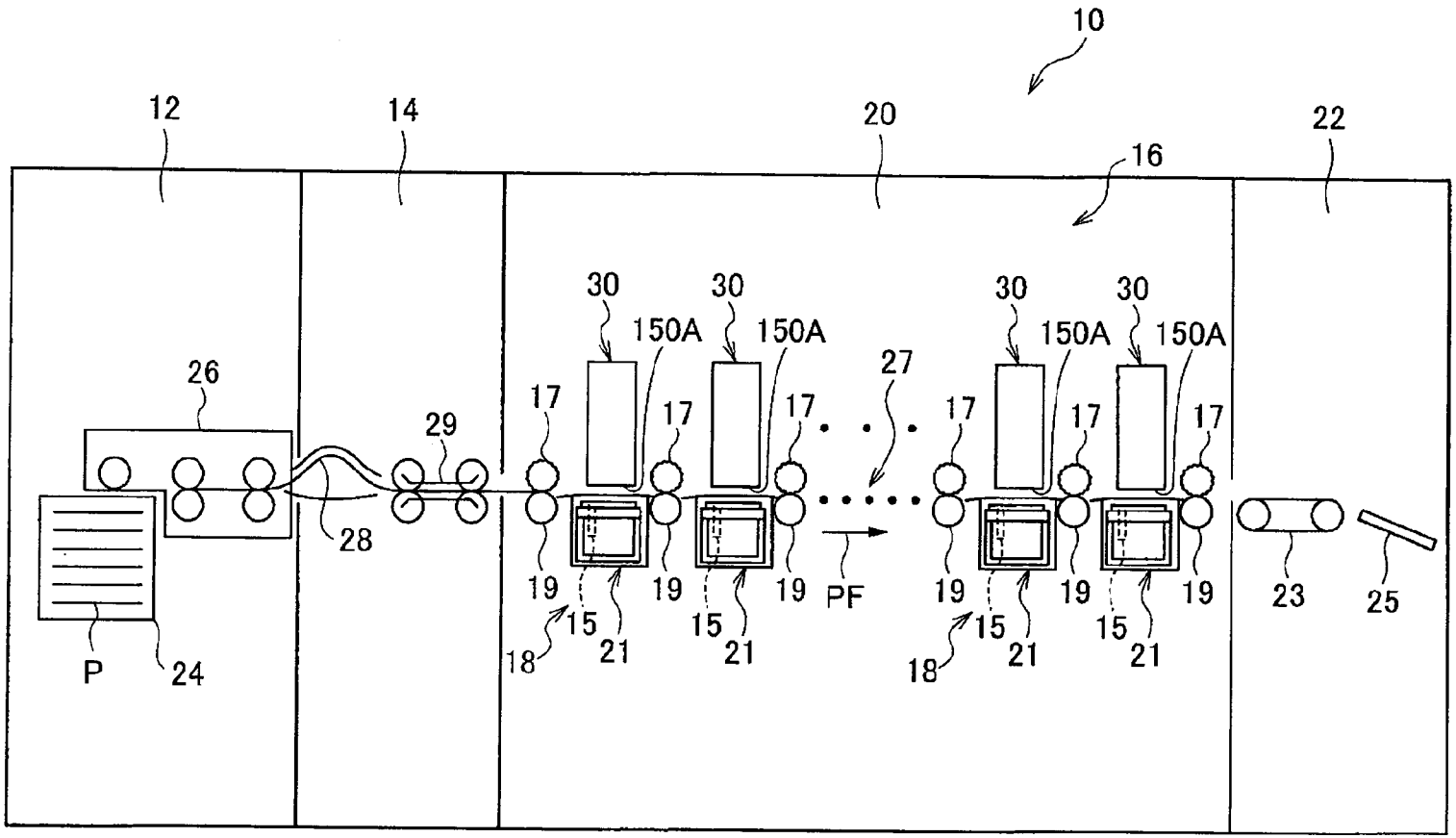

As shown in FIG. 1, the inkjet recording apparatus 10 includes a sheet supply unit 12 which sends out a recording sheet P (recording medium), a registration adjusting unit 14 that controls the posture of the recording sheet P, a recording unit 20 that has a recording head unit 16 for forming an image on the recording sheet P by jetting out ink droplets and a maintenance unit 18 which maintains the recording head unit 16, and an ejecting unit 22 that ejects the recording sheet P on which the image was formed by the recording unit 20.

The sheet supply unit 12 includes a stacker 24 in which recording sheets P are stored (stacked) and a conveying unit 26 which takes out recording sheets P from the stacker 24 one by one and conveys them to the registration adjusting unit 14. The registration adjusting unit 14 has a loop forming unit 28 and a guide member 29 that controls the posture of a recording sheet P. While a recording sheet P passes through the registration adjusting unit 14, its skew is corrected utilizing its stiffness and its conveyance timing is controlled. The recording sheet P is then supplied to the recording unit 20. On the other hand, the ejecting unit 22 conveys a recording sheet P on which an image has been formed by the recording unit 20 and puts it onto a tray 25.

In the recording unit 20, the recording head unit 16 and the maintenance unit 18 are opposed to each other in the vertical direction. A sheet conveying path 27 along which a recording sheet P received from the registration adjusting unit 14 is conveyed is formed between the recording head unit 16 and the maintenance unit 18. Plural sets of a star wheel 17 and a conveying roll 19 that are opposed to each other in the vertical direction. Each of the plural sets of the star wheel 17 and the conveying roll 19 is disposed on the upstream side and the downstream side of the corresponding inkjet recording unit 30 along the sheet conveying path 27. A recording sheet P is conveyed continuously (without being stopped) while being sandwiched between the star wheels 17 and the conveying rolls 19.

The recording head unit 16 is equipped with plural inkjet recording units 30 which are arranged at predetermined intervals along the sheet conveying path 27. To enable recording of, for example, a full-color image, at least four inkjet recording units 30 for yellow (Y), magenta (M), cyan (C), and black (K) are disposed.

Figure 2:
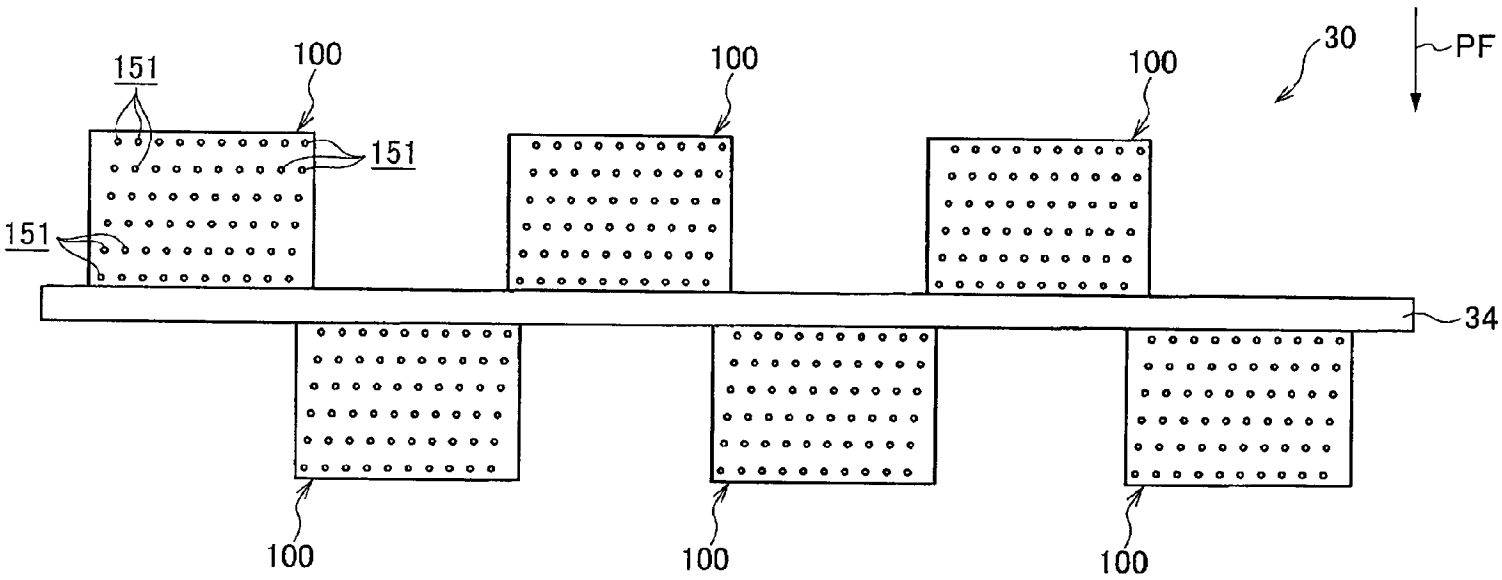
FIG. 2 illustrates how inkjet recording heads used in the embodiment of the invention and their nozzle surfaces are arranged.

As shown in FIG. 2, each inkjet recording unit 30 is equipped with a support member 34 which is disposed with its longitudinal direction extending in the sheet width direction which is perpendicular to a sheet conveying direction which is indicated by arrow PF. Plural inkjet recording heads 100 are attached to the support member 34. The bottom surface, opposed to the sheet conveying path 27, of each inkjet recording head 100 is a nozzle surface 150A (see FIG. 1). Plural nozzles 151 are formed in matrix form in the nozzle surface 150A so that a constant pitch is obtained in the width direction of a recording sheet P by the entire inkjet recording unit 30. Inkjets as example droplets of a jetting liquid are jetted out by the nozzles 151 so that an image is formed on a recording sheet P.

As shown in FIG. 1, the maintenance unit 18 is equipped with plural maintenance devices 21 which are opposed to the respective inkjet recording units 30 and serve for maintenance of the inkjet recording heads 100. Each maintenance device 21 has a wiping blade 15 which wipes the nozzle surfaces 150A of the associated inkjet recording heads 100. Each maintenance device 21 also has a spray device 200 which sprays maintenance liquid on the nozzle surfaces 150A (see FIG. 4; described later in detail) before, for example, a wiping operation of wiping the nozzle surfaces 150A of the inkjet recording heads 100 with the wiping blade 15.

The width of a printing range of each inkjet recording unit 30 is set wider than the width of a maximum recording sheet P for which image recording by the inkjet recording apparatus 10 is assumed. Thus, image recording can be performed over the entire width of a recording sheet P without moving each inkjet recording unit 30 in the sheet width direction.

Basically, the width of the printing range is set for the longest one of recording ranges each of which is equal to the length between both ends of each kind of recording sheet P minus non-printing margin lengths. However, in general, the width of the printing range is set longer than the maximum width of sheets for printing, because a recording sheet P may be conveyed so as to be inclined from the conveying direction within a predetermined allowable angular range (i.e., skewed) and there is much demand for marginless printing.

<Inkjet Recording Head>

Next, each inkjet recording head 100 which is an example droplet jetting head will be described. In the following, the terms "top-bottom direction" and "right-left direction" are directions in a state that each inkjet recording head 100 is attached to the inkjet recording unit 30 of the inkjet recording apparatus 10 (see FIG. 1).

Figure 3B:
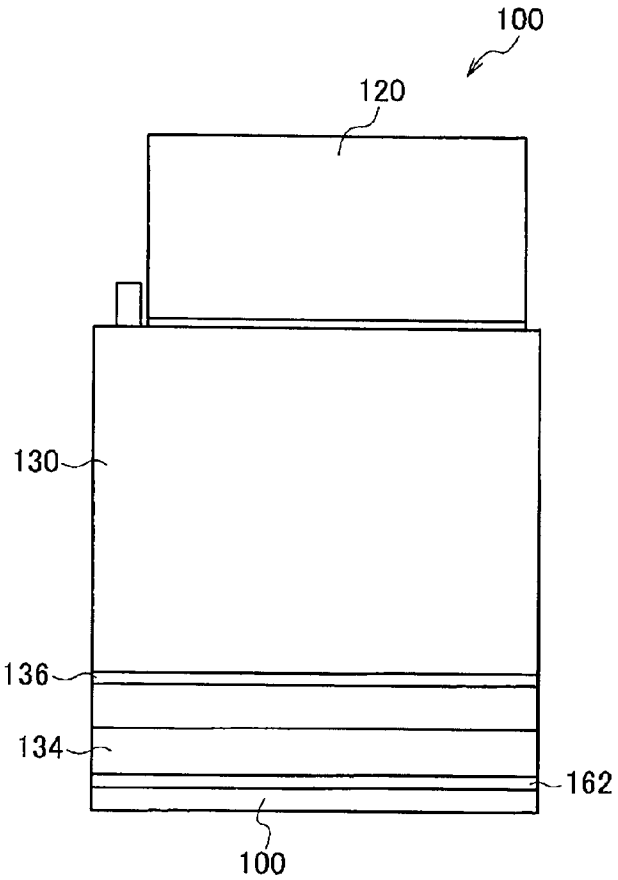
FIGS. 3A and 3B are a front view and a side view, respectively, of each inkjet recording head used in the embodiment of the invention.
Figure 3A:
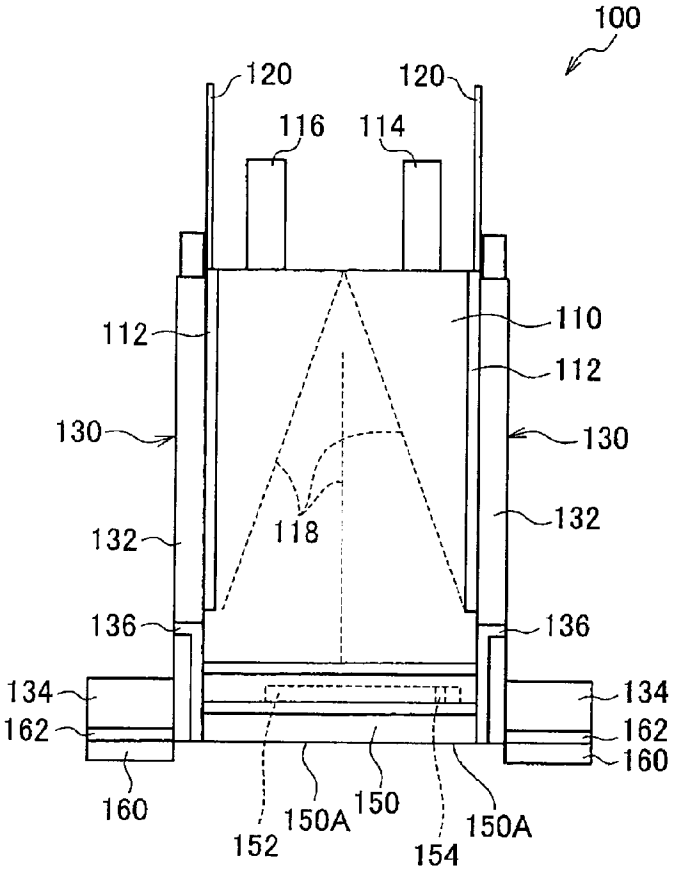

As shown in FIGS. 3A and 3B, each inkjet recording head 100 includes a manifold 110, a recording head board 150, protective covers 160 which protect the recording head board 150, flexible boards 120 which are connected to the recording head board 150, and cover members 130 located outside the respective flexible boards 120.

The manifold 110 has an inlet 114 through which ink is supplied and an outlet 116 through which ink is ejected. Filters 118 are disposed inside the manifold 110. The above-mentioned recording head board 150 is disposed under the manifold 110. The bottom surface of the recording head board 150 is the above-mentioned nozzle surface 150A in which the nozzles 151 (see FIG. 2) which jet out ink droplets are formed. An ink flow passage through ink supplied from the manifold 110 flows, a pressure room, piezoelectric elements for jetting out ink droplets from the nozzles 151 (see FIG. 2) by pressuring the ink charged in the pressure room, and other things are provided inside the recording head board 150. The recording head board 150 is also provided with an electric circuit for driving the piezoelectric elements.

The flexible boards 120 are disposed alongside the two respective side surfaces of the manifold 110. The cover members 130 which are L-shaped in a plan view are disposed outside the respective flexible boards 120 in the right-left direction. Each cover member 130 is composed of a first cover member 132 and a second cover member 134. A protective cover 160 is joined to the bottom surface of the second cover member 134.

The first cover member 132 of each cover member 130 is joined (bonded) to the side surface of the manifold 110 by a bonding member 112 with the associated flexible board 120 sandwiched between them. The second cover member 134 of each cover member 130 is joined (bonded) to the side surface of the manifold 110 and the side surface of the recording head board 150 by a bonding member 136. The first cover member 132 and the second cover member 134 are joined (bonded) to each other by the bonding member 136. A protective cover 160 is joined (bonded) to the second cover member 134 of each cover member 130 by a bonding member 162.

The inkjet recording head 100 is equipped with a head temperature increasing device 152 which increases the temperature of the recording head board 150 mainly and a head temperature detecting device (temperature sensor) 154 which detects the temperature of the recording head board 150. The head temperature increasing device 152 and the head temperature detecting device 154 are electrically connected to a control device 300 (see FIG. 4, described later in detail).

<Ink Supply Device and Spray Device>

Next, an ink supply device 180 and the spray device 200 will be described with reference to FIG. 4. Arrow S1 indicates an ink flow (passage) and arrow S2 indicates a flow (passage) of a maintenance liquid.

Figure 4:
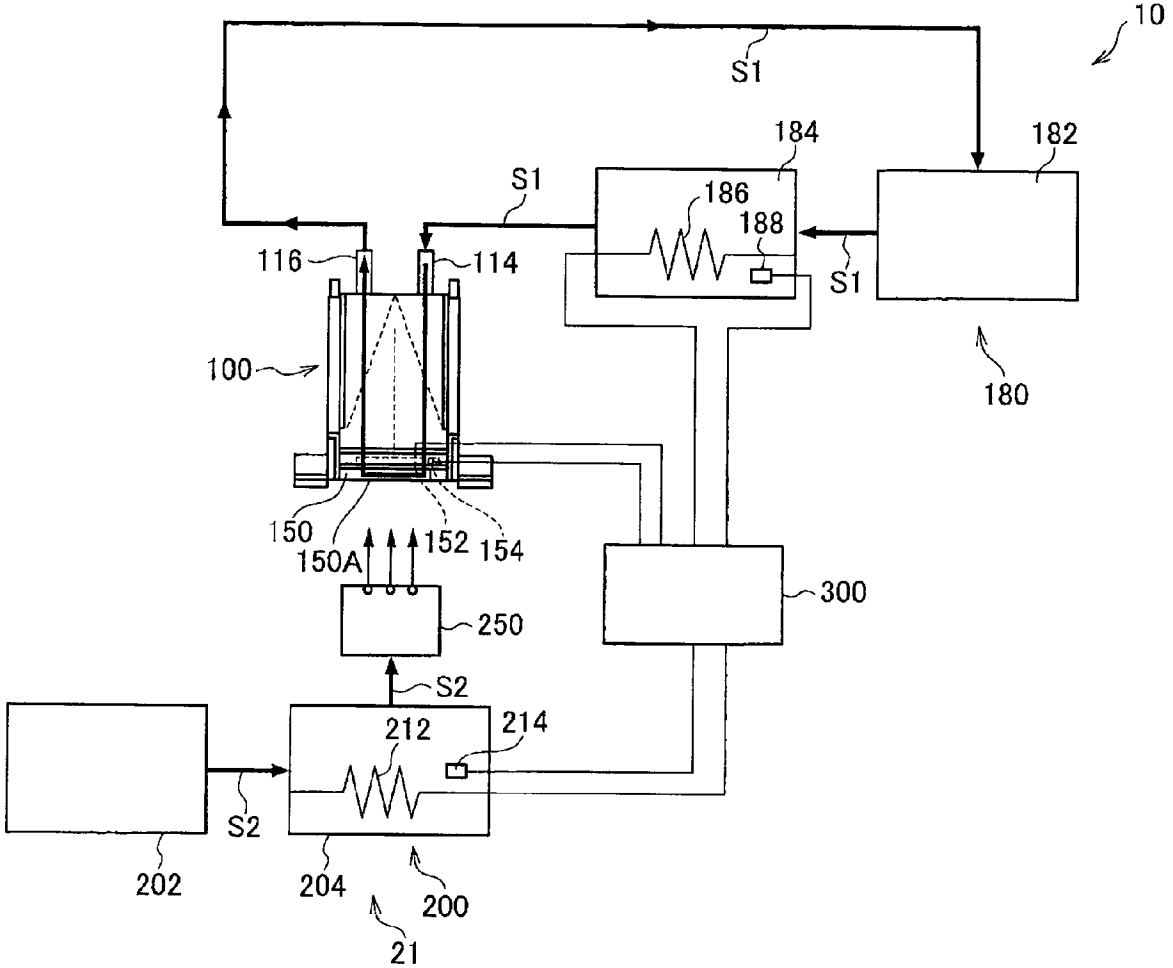
FIG. 4 shows the configuration of an important part of the inkjet recording apparatus according to the embodiment of the invention.

As shown in FIG. 4, the inkjet recording apparatus 10 is equipped with the ink supply device 180 which supplies ink to the inkjet recording heads 100. The ink supply device 180 is equipped with a main ink tank 182 and a sub-ink tank 184 which store ink. Ink is supplied from the main ink tank 182 to the sub-ink tank 184, and then supplied from the sub-ink tank 184 to the inlet 114 of the manifold 110 of each inkjet recording head 100. The ink is supplied from the inlet 114 to the manifold 110, then supplied to the recording head board 150, returned to the manifold 110, and ejected from the outlet 116. The ink that has been ejected from the outlet 116 is returned to the main ink tank 182. The ink is thus circulated.

The sub-ink tank 184 is equipped with an ink temperature increasing device 186 for increasing the temperature of the ink stored in the sub-ink tank 184 and an ink temperature detecting device (temperature sensor) 188 for detecting the temperature of the ink stored in the sub-ink tank 184. The ink temperature increasing device 186 and the ink temperature detecting device 188 are electrically connected to the control device 300 (described later in detail).

As described above, each maintenance device 21 of the inkjet recording apparatus 10 has the spray device 200 for spraying maintenance liquid on the nozzle surfaces 150A before, for example, a wiping operation of wiping the nozzle surfaces 150A with the wiping blade 15 (see FIG. 1).

The spray device 200 includes a spray head 250 which jets out maintenance liquid and spraying it on the nozzle surfaces 150A, a main maintenance liquid tank 202 and a sub-maintenance liquid tank 204 which store maintenance liquid.

Maintenance liquid is supplied from the main maintenance liquid tank 202 to the sub-maintenance liquid tank 204, and then supplied from the sub-maintenance liquid tank 204 to the spray head 250. Maintenance liquid is jetted toward (sprayed on) the nozzle surface 150A of the recording head board 150 from the spray head 250.

The mechanism for causing the spray head 250 to jet out maintenance liquid and spray it on the nozzle surfaces 150A may be of any kind. For example, a configuration is possible in which the pressure of maintenance liquid is increased with a pump or the like and maintenance liquid is jetted out from nozzles.

The sub-maintenance liquid tank 204 is equipped with a maintenance liquid temperature increasing device 212 which increases the temperature of the maintenance liquid stored in the sub-maintenance liquid tank 204 and a maintenance liquid temperature detecting device (temperature sensor) 214 which detects the temperature of the maintenance liquid stored in the sub-maintenance liquid tank 204. The maintenance liquid temperature increasing device 212 and the maintenance liquid temperature detecting device 214 are electrically connected to the control device 300 (described later in detail).

The control device 300 includes a CPU (central processing unit), a memory, etc. The control device 300 controls the head temperature increasing device 152, the ink temperature increasing device 186, and the maintenance liquid temperature increasing device 212 to attain prescribed temperatures or cause the temperatures to fall within prescribed temperature ranges on the basis of detection results (temperatures) of the head temperature detecting devices 154, the ink temperature detecting device 188, and the maintenance liquid temperature detecting device 214.

<Temperature Control>

Next, temperature control by the control device 300 will be described. The temperature of the inkjet recording heads 100, the ink temperature, and the maintenance liquid temperature are represented by HT, IT, and MT, respectively.

During an ordinary printing operation (i.e., while a maintenance operation by each maintenance device 21 is not being performed), the control device 300 controls the temperatures HT and IT to predetermined temperatures which are 30° C. in the embodiment.

On the other hand, during a maintenance operation of causing each spray head 250 to jet out maintenance liquid and spraying it on the nozzle surfaces 150A, the control device 300 controls the temperature MT of the maintenance liquid so as to satisfy a relationship MT≥HT (=IT) while maintaining the temperatures HT and IT. That is, the control device 300 controls the temperature MT of the maintenance liquid (part of which is jetted out from the spray head 250) so that the temperature MT of the maintenance liquid is kept higher than or equal to the temperature HT of the inkjet recording heads 100.

In the embodiment, the temperature MT is controlled so as to fall with in a range of 30° C. to 45° C. In the embodiment, it is preferable that the temperature MT be controlled so as to be lower than or equal to 60° C. taking into consideration the durability etc. of the bonding members 112, 136, and 162, sealing members, and water-repellant members formed on the nozzle surfaces 150A etc.

<Workings and Advantages>

Next, workings and advantages will be described.

As mentioned above, the temperature MT of maintenance liquid that is jetted out from the spray head 250 is controlled so as to be kept higher than or equal to the temperature HT of the inkjet recording heads 100 (MT≥HT (=IT)). Therefore, reduction of the temperature HT of the inkjet recording heads 100 caused by spraying of maintenance liquid on the nozzle surfaces 150A is suppressed. Therefore, contraction of various constituent members of the inkjet recording heads 100, local generation of negative pressures in (approximately) closed spaces inside the inkjet recording heads 100, and other problems due to temperature reduction of the inkjet recording heads 100 are suppressed or prevented.

Examples of the (approximately) closed spaces inside each inkjet recording head 100 are the spaces of gaps and projection/recesses formed inside the inkjet recording head 100 and the ink flow passage and the pressure room formed inside the recording head board 150.

Furthermore, entrance of maintenance liquid into each inkjet recording head 100 through the bonding surfaces of the bonding members 112, 136, and 162 and other sealing surfaces which may be caused by contraction of related members and local negative pressures, resulting deterioration of the bonding members 112, 136, and 162 and electric circuits, degradation of printing quality due to mixing of maintenance liquid sucked through the nozzles 151 (see FIG. 2) with ink, and other problems are suppressed or prevented.

No particular limitations are imposed on the components of the inks (example jetting liquids) and the maintenance liquid. In the embodiment, the pigment inks are employed and the maintenance liquid is a liquid obtained by removing pigment components from each ink. The maintenance liquid may be added with a component for improving the performance of cleaning of the nozzle surfaces 150A.

Depending on the components of the maintenance liquid and the components of each ink, the viscosity of ink may be increased if maintenance liquid is sucked through the nozzles 151 and mixed with the ink. The increased viscosity of the ink may affect the jetting characteristics to lower the printing quality. However, in the embodiment, since as described above the temperature of the maintenance liquid is controlled, the phenomenon that maintenance liquid is sucked through the nozzles 151 and mixed with ink is suppressed or prevented. Thus, reduction of the printing quality due to increase of the ink viscosity is suppressed or prevented.

Even if the temperature of the maintenance liquid is controlled but is lower than the temperature of the inkjet recording heads 100, the reduction of the heat temperature HT is smaller than in the case that maintenance liquid is not controlled (its temperature is much lower than the temperature of the inkjet recording heads 100). A relationship between the difference ΔT (° C.) between the temperature MT of the maintenance liquid and the temperature HT of the inkjet recording heads 100 (ink temperature IT) and occurrence of a pressure reduction state inside the inkjet recording heads 100 will be described below with reference to FIG. 5.

In the table of FIG. 5, a case that no pressure reduction state (local negative pressure) occurs in the inkjet recording heads 100 (OK level) is represented by character A, a case that a pressure reduction state occurs (NG level) is represented by character C, and a case that a pressure reduction state occurs but it does not cause any problem (OK level) is represented by character B.

As seen from FIG. 5, no problem occurs if the temperature difference ΔT is larger than or equal to −5° C. That is, problems due to contraction of members or local negative pressures are prevented if a control is made so that a relationship MT−HT=ΔT≥−5° C. is satisfied.

<Modifications>

Next, Modification(s) of the exemplary embodiment(s) of the present invention will be hereinafter described.

(Modification 1)

Figure 6:
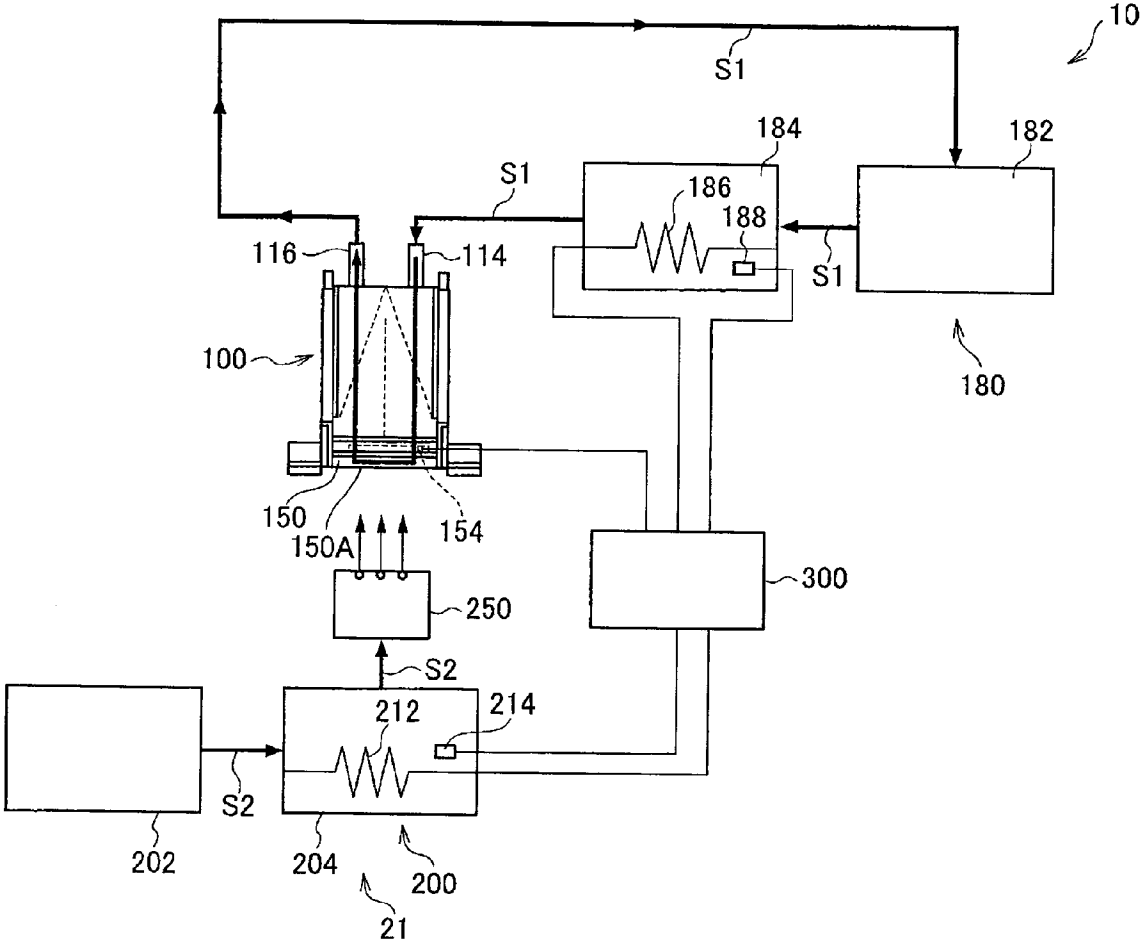
FIG. 6 corresponds to FIG. 4 and shows the configuration of an important part of an inkjet recording apparatus according to a first modification of the embodiment.

In a first modification, as shown in FIG. 6, the head temperature increasing devices 152 (see FIG. 4) are not provided. In the first modification, the temperature of the inkjet recording heads 100 is controlled using temperature-increased ink. The control device 300 controls the temperature MT of the maintenance liquid so as to attain a relationship MT≥HT or MT−HT=ΔT≥−5° C.

In the configuration of FIG. 6, the head temperature detecting devices 154 may be omitted. In this case, it is assumed that the temperature HT of the inkjet recording heads 100 is approximately equal to the increased and controlled temperature IT of the ink. The control device 300 controls the temperature MT of the maintenance liquid so as to attain the relationship MT≥IT or MT−IT=ΔT≥−5° C.

(Modification 2)

Figure 7:
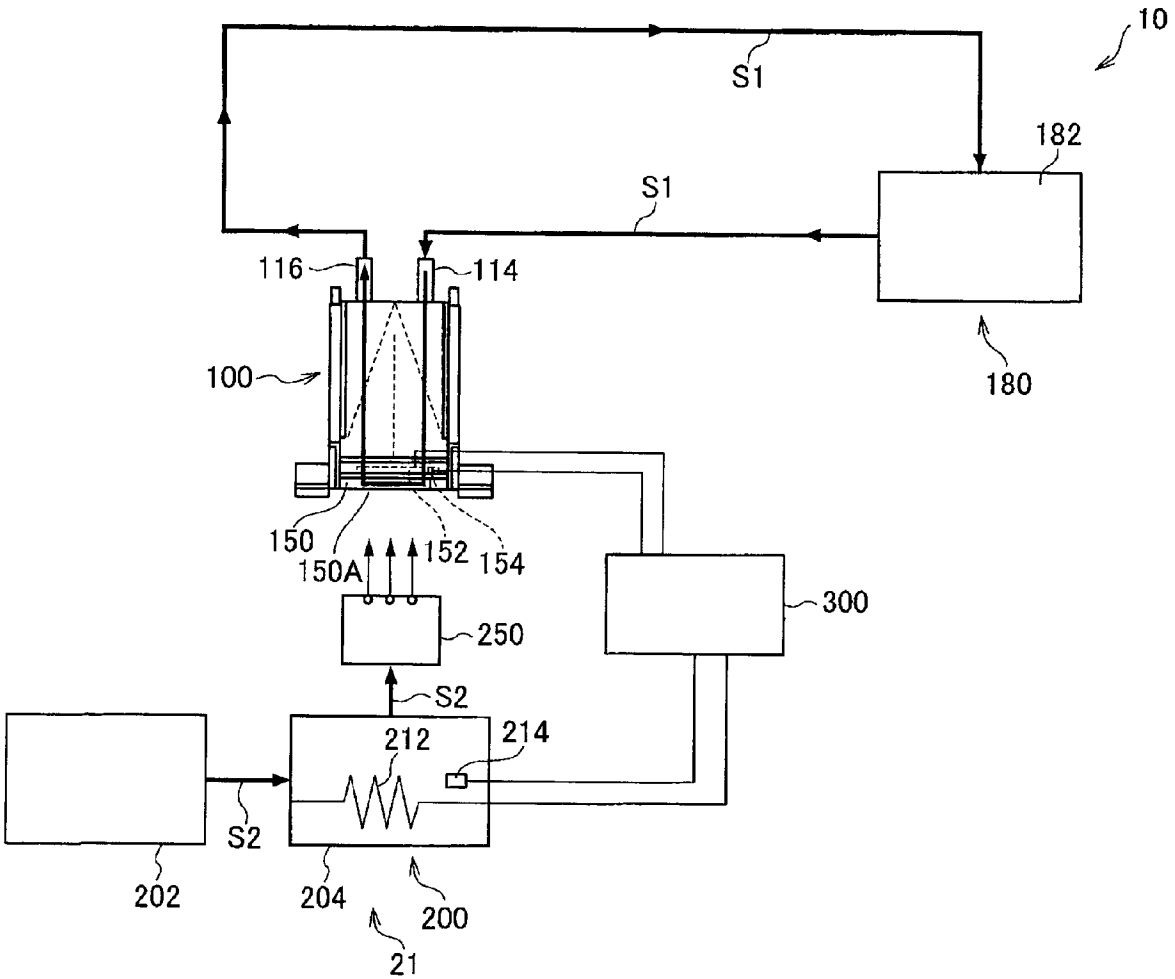
FIG. 7 corresponds to FIG. 4 and shows the configuration of an important part of an inkjet recording apparatus according to a second modification of the embodiment.

In a second modification, as shown in FIG. 7, the sub-ink tank 184 (see FIG. 4) is not provided, that is, neither the ink temperature increasing device 186 nor the ink temperature detecting device 188 is provided. Also in the second modification, the control device 300 controls the temperature MT of the maintenance liquid so as to attain the relationship MT≥HT or MT−HT=ΔT≥−5° C.

In the configuration of FIG. 7, the head temperature increasing devices 152 may also be omitted. In this case, the temperature HT of the inkjet recording heads 100 and the temperature IT of the ink vary depending on the ambient temperature, the temperature inside the apparatus, or the like. Also in this case, the control device 300 controls the temperature MT of the maintenance liquid so as to attain the relationship MT≥HT or MT−HT=ΔT≥−5° C.

(Modification 3)

Figure 8:
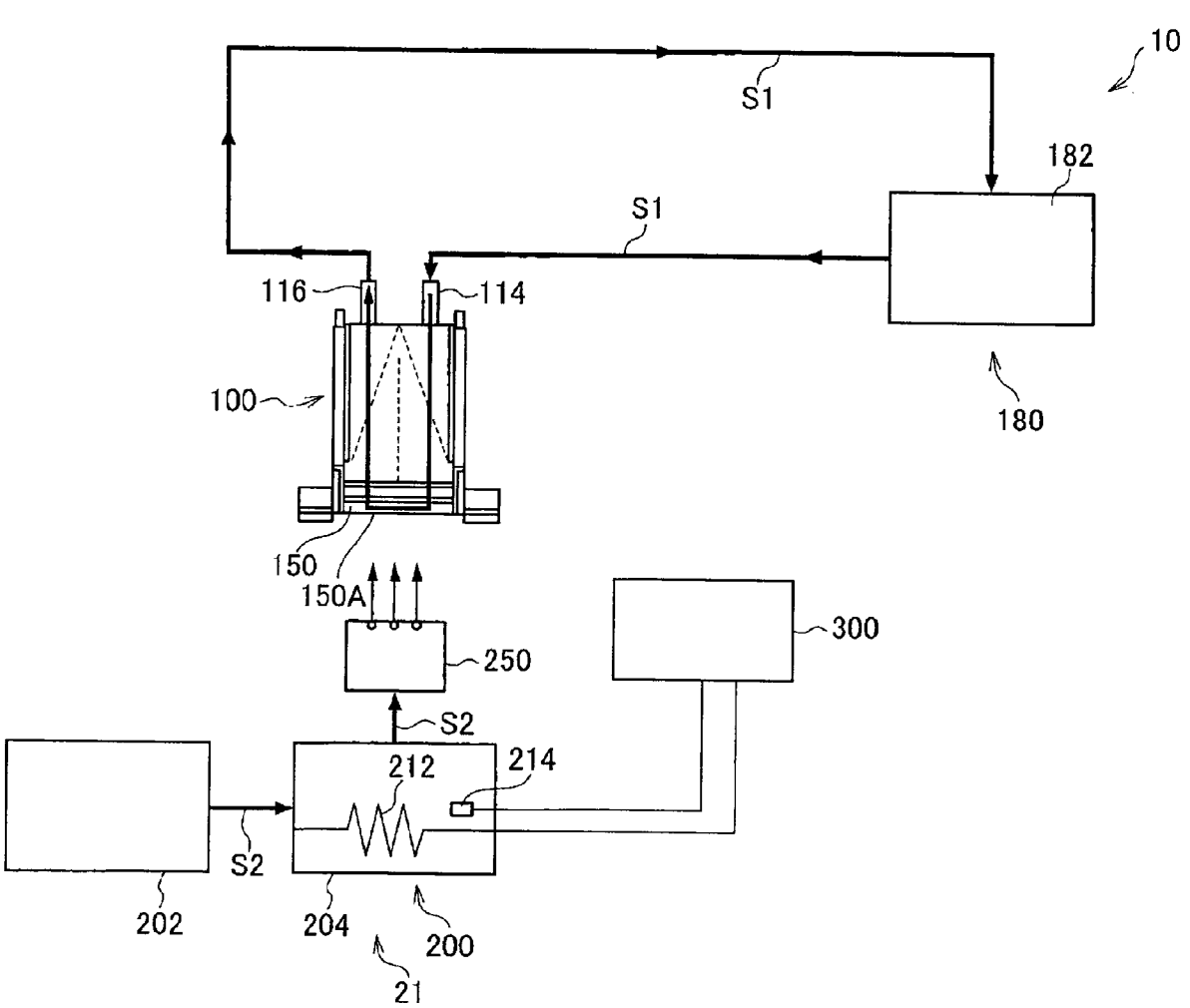
FIG. 8 corresponds to FIG. 4 and shows the configuration of an important part of an inkjet recording apparatus according to a third modification of the embodiment.

In a third modification, as shown in FIG. 8, none of the head temperature increasing devices 152, the head temperature detecting device 154, and the sub-ink tank 184 (the ink temperature increasing device 186 and the ink temperature detecting device 188; see FIG. 4) are provided.

In this case, the temperature HT of the inkjet recording heads 100 (and the temperature IT of the ink) varies depending on the ambient temperature, the temperature inside the apparatus, or the like. The control device 300 controls the temperature MT of the maintenance liquid so that it is kept equal to a predetermined temperature which is equal to 40° C., for example.

Alternatively, assuming that the temperature of the inkjet recording heads 100 (and the ink) is approximately equal to the ambient temperature, the temperature inside the apparatus, or the like, the control device 300 controls the temperature MT of the maintenance liquid so as to attain the relationship MT≥GT (=HT) or MT−GT (=HT)=ΔT≥−5° C., where GT is a separately measured ambient temperature or temperature inside the apparatus.

(Other Modifications)

The presence/absence combination of the head temperature increasing devices 152, the head temperature detecting device 154, the ink temperature increasing device 186, and the ink temperature detecting device 188 may be ones other than the ones described in the first to third modifications.

<Others>

The invention is not limited to the above embodiment.

For example, although in the embodiment the temperature of the maintenance liquid stored in the sub-maintenance liquid tank 204 is increased, the temperature of the maintenance liquid stored in the main maintenance liquid tank 202 may be increased. As a further alternative, the temperature of the spray head 250 may be increased. That is, any temperature increasing place or method may be employed as long as it can increase the temperature of the maintenance liquid.

Although in the embodiment the temperature of the maintenance liquid is detected by measuring the temperature of the maintenance liquid stored in the sub-maintenance liquid tank 204, the invention is not limited to such a case. For example, the temperature of the spray head 250 or the maintenance liquid flowing through the flow passage S2 may be measured.

If there is a probability that a predetermined temperature MT, HT, or IT becomes lower than an ambient temperature or a temperature inside the apparatus (e.g., the temperature HT is set at 30° C. and the apparatus is installed at a place where the ambient temperature becomes higher than 30° C. or the temperature inside the apparatus becomes higher than 30° C. because of heat sources disposed inside the apparatus), temperature control may be performed by providing cooling devices in addition to the temperature increasing devices. Also in this case, the control device 300 controls the temperature MT so as to attain the relationship MT≥HT (or IT) or MT−HT (or IT)=ΔT≥−5° C.

In the droplet jetting head and the droplet jetting apparatus according to the invention, the "recording medium" as a subject of image recording broadly includes various targets toward which the droplet jetting head jets droplets. The "image" or "recording image" produced by the droplet jetting apparatus according to the invention broadly includes various forms of dot patterns which are formed on a recording medium when droplets stick to the recording medium. Therefore, the droplet jetting apparatus according to the invention is not limited to ones which are used for recording a text or an image on a recording sheet. The recording medium naturally includes a recording sheet, an OHP sheet, etc. and also includes other things such as a board on which a wiring pattern etc. are to be formed. The "image" includes not only common images (character, picture, photograph, etc.) but also a wiring pattern (mentioned above), a three-dimensional object, an organic thin film, etc. The jetting liquid is not limited to colored inks. The droplet jetting head and the droplet jetting apparatus according to the invention can be applied to various general industrial uses such as manufacture of display color filters in which colored inks are jetted onto a polymer film or a glass plate, formation of components mounting bumps in which molten solder is jetted onto a board, formation of an EL display panel in which a solution of an organic EL substance is jetted onto a substrate, and formation of electric mounting bumps in which molten solder is jetted onto a board.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet jetting apparatus comprising:

a droplet jetting head that is supplied with a jetting liquid and jets out droplets of the jetting liquid from nozzles formed in a nozzle surface;

a spray device that sprays maintenance liquid on the nozzle surface; and a maintenance liquid temperature control unit that controls a temperature of the maintenance liquid so that the temperature of the maintenance liquid comes closer to or becomes higher than or equal to a temperature of the droplet jetting head.

2. The droplet jetting apparatus according to claim 1, further comprising:

a head temperature control unit that controls a temperature of the droplet jetting head so that the temperature of the droplet jetting head comes closer to a prescribed temperature.

3. The droplet jetting apparatus according to claim 1, further comprising:

a jetting liquid temperature control unit that controls the temperature of the jetting liquid supplied to the droplet jetting head so that the temperature of the jetting liquid comes closer to a prescribed temperature.

4. The droplet jetting apparatus according to claim 1, wherein:

the maintenance liquid temperature control unit controls the temperature of the maintenance liquid during a maintenance operation for the droplet jetting head.

5. A droplet jetting apparatus comprising:

a droplet jetting head that is supplied with a jetting liquid and jets out droplets of the jetting liquid from nozzles formed in a nozzle surface;

a spray device that sprays maintenance liquid on the nozzle surface; and a maintenance liquid temperature control unit that controls a temperature of the maintenance liquid so that it becomes higher than or equal to a temperature of the jetting liquid supplied to the droplet jetting head.

6. A droplet jetting apparatus comprising:

a droplet jetting head that is supplied with a jetting liquid and jets out droplets of the jetting liquid from nozzles formed in a nozzle surface;

a spray device that sprays maintenance liquid on the nozzle surface; and a maintenance liquid temperature increasing unit that increases a temperature of the maintenance liquid that is about to be sprayed.

7. A maintenance method of a droplet jetting head, comprising:

controlling a temperature of a maintenance liquid so that the temperature of the maintenance liquid comes closer to or becomes higher than or equal to a temperature of the droplet jetting head; and spraying the temperature-controlled maintenance liquid on a nozzle surface of the droplet jetting head, nozzles that jets out droplets of a jetting liquid being formed in the nozzle surface.

* * * * *